United States Patent [19]

Hefner, Jr. et al.

[11] 4,287,052

[45] Sep. 1, 1981

[54] ALKYL-SUBSTITUTED PHENYL ETHER AMINE COLLECTORS IN FLOTATION

[75] Inventors: Robert E. Hefner, Jr., Lake Jackson, Tex.; Donald A. Tomalia, Midland, Mich.

[73] Assignee: The Dow Chemical Company, Midland, Mich.

[21] Appl. No.: 137,663

[22] Filed: Apr. 7, 1980

[51] Int. Cl.[3] ..... B03D 1/02

[52] U.S. Cl. ..... 209/166

[58] Field of Search ..... 209/166, 167; 260/584 C; 252/61

[56] References Cited

U.S. PATENT DOCUMENTS

| | | | |
|---|---|---|---|
| 2,327,408 | 8/1943 | Ellis | 209/166 |
| 2,341,046 | 2/1944 | Kirby | 209/166 |
| 2,386,821 | 8/1944 | Christmann | 209/166 |
| 3,076,819 | 2/1963 | Heise | 209/166 X |
| 3,179,697 | 4/1965 | Frump | 260/584 C X |
| 3,292,780 | 12/1966 | Frommer | 209/166 X |
| 3,363,758 | 1/1968 | Cronberg | 209/166 |
| 4,168,227 | 9/1979 | Polgaire | 209/166 |
| 4,172,029 | 5/1978 | Hefner | 209/166 |

*Primary Examiner*—Robert Halper
*Attorney, Agent, or Firm*—Michael L. Glenn

[57] ABSTRACT

In the beneficiation of phosphate ore by flotation of siliceous material, the use of an alkyl-substituted phenyl ether amine or a hydroxyalkylated derivative thereof as a collector affords improved separation of phosphate from the siliceous matter.

9 Claims, No Drawings

ALKYL-SUBSTITUTED PHENYL ETHER AMINE COLLECTORS IN FLOTATION

BACKGROUND OF THE INVENTION

This invention relates to an improved process for phosphate beneficiation. In particular, this invention relates to the use of an alkyl-substituted phenyl ether amine or its hydroxyalkylated derivative as a collector in the flotation of siliceous material from a mineral ore.

In the present commercial beneficiation of siliceous phosphate ores, a deslimed and sized phosphate ore is conditioned with and then floated by a fatty acid collector and fuel oil reagent in an aerated aqueous solution at a pH of at least about 8. This flotation process produces a low-grade phosphate concentrate containing from about 50 to 65 weight percent bone phosphate of lime (BPL). The low-grade concentrate from the aforementioned flotation is blunged with acid to remove fatty acid collector coatings and the phosphate is further concentrated by flotation of residual silica from the concentrate with a so-called cationic amine collector. Other mineral ores containing siliceous material, such as iron ore, are also beneficiated by flotation.

Polyethylenepolyamines (most frequently diethylenetriamine) condensed with a fatty acid are the current cationic amine collectors of choice in the art for the flotation of silica from phosphate. These condensates are effective collectors, but they are costly and only moderately active.

SUMMARY OF THE INVENTION

A process for beneficiating a siliceous mineral ore by froth flotation with a collector system for the flotation of siliceous matter is improved wherein the collector system comprises an effective amount of a compound represented by the formula I

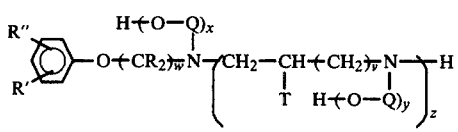

I or an acid-neutralized derivative of this compound. In the above formula, R′ is an aliphatic radical having from 2 to 22 carbon atoms; R″ is hydrogen or an aliphatic radical having from 1 to 22 carbon atoms; each R is independently hydrogen, a $C_1$–$C_4$ hydroxyalkyl or $C_1$–$C_4$ alkyl; Q is

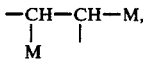

wherein M at each occurrence is independently hydrogen, methyl or ethyl, with the proviso that Q at each occurrence contains no more than 4 carbon atoms; T is hydrogen or methyl; w is 2 or 3, and v, x, y and z are each independently 0 or 1.

DETAILED DESCRIPTION OF THE INVENTION

The ether monoamines are represented by formula I (wherein x and z are both 0), are conveniently prepared in a two-step process. First, a 2-oxazoline or an oxazine represented by the formula

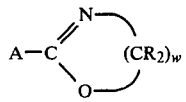

wherein R and w have the aforementioned identities, and A is a phenyl or $C_1$–$C_{20}$ alkyl, is reacted at about 150° C. to about 250° C. in a liquid phase with an alkylated phenol represented by the formula

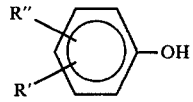

wherein R′ and R″ have the aforementioned identities, to prepare the corresponding amide. This amide represented by the formula

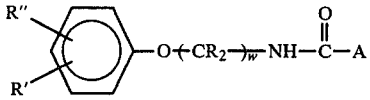

is then hydrolyzed to produce the ether amine of formula I. Alternatively, the monoalkanolamine and carboxylic acid precursors of the 2-oxazoline or oxazine can be employed in place of the heterocyclic reactant at reaction conditions conducive to the formation in situ of the oxazoline or oxazine reactant.

Certain ether diamines (i.e., where v and z are both 1 in formula I) are readily prepared by reacting the corresponding ether monoamine with acrylonitrile or methacrylonitrile and then hydrogenating the resulting ether amine nitrile. This reaction is taught in U.S. Pat. No. 3,363,758. The other ether diamines (i.e., where v is 0 and z is 1 in formula I) are conveniently prepared by reacting an ether monoamine with chloroacetonitrile and then hydrogenating the resulting ether amine nitrile. A similar reaction is taught in German Offen. No. 2,515,383, the relevant portions of which are incorporated by reference.

Hydroxyalkylated derivatives of ether amines depicted by formula I wherein y or x is 1 are conveniently prepared by reacting one or two equivalents of ethylene oxide, propylene oxide, 2,3-butylene oxide, 1,2-butylene oxide or a mixture thereof with the corresponding ether amine in a manner known to the art. Ethylene oxide is the preferred alkylene oxide reactant. One equivalent of the alkylene oxide is preferably employed for each equivalent of a primary amine moiety in the compound of formula I. It is operable, but not preferred, to employ one equivalent of alkylene oxide for each equivalent of primary or secondary amine moiety in the compound of formula I.

The above-described ether amines and hydroxyalkylated derivatives neutralized or partially neutralized with inorganic or organic acids are also operable as collectors. These derivatives are generally more readily dispersed in the aqueous flotation medium than are their parent compounds. These acid-neutralized derivatives may be salts, partial salts or acid complexes. Common inorganic acids which can be used to prepare salts include, phosphoric, nitric, boric, hydrochloric, hydrobromic and sulfuric acids. Organic acids which can be used include aliphatic mono-, di- or tricarboxylic acids; lower alkyl carboxylic acids; mono- or dihydroxy lower alkyl carboxylic acids and amino-substituted compounds thereof; and unsaturated aliphatic acids. Examples of these organic acids include formic, acetic, propionic, butyric, isovaleric, glycolic, lactic, gluconic, aminoacetic, malonic, succinic, adipic, malic, tartaric, glutaric, maleic, fumaric, citric, isocitric, aconitic, oxalic, salicylic, carbonic, benzoic, and naphthenic acids, and the like. Fatty acids can also be employed for this purpose, but are not as desirable as the lower organic acids. Acetic acid is particularly preferred to prepare these acid-neutralized derivatives.

Certain of the compounds represented by formula I demonstrate greater activity and/or selectivity as collectors than others. For this reason, it is preferred that w is 2. Preferably, R, T and R'' are each hydrogen and z is 0. It is also preferred that R' is a normal or branched alkyl having from 5 to about 20 carbon atoms, more preferably having from 8 to 18 carbon atoms. It has been observed that compounds of formula I wherein x and y are both 0 generally possess greater activity as collectors than similar compounds wherein x or y is 1. On the other hand, the compounds wherein x or y is 1, in general, exhibit somewhat greater selectivity.

The siliceous mineral ore can be phosphate rock, magnetite, hamatite, goethite or other silica-containing minerals, but the process is particularly applicable to phosphate ore. The general process for beneficiation of siliceous ores by flotation, with a collector is taught in U.S. Pat. No. 3,363,758. The instant collector can be employed in a manner similar to that taught for a different collector in the aforementioned patent, which is incorporated herein by reference.

The cationic amine collector of the present invention can be used alone or in a mixture with other collectors. In particular, this collector can be used in conjunction with conventional diethylenetriamine/tall oil flotation agents. The term "effective amount" is used herein to denote the amount of collector required to enhance the recovery or selectivity of the collector system. The collector can likewise be used in conjunction with other adjuvants such as activators, conditioning reagents, dispersing reagents, frothing reagents and depressing reagents. In one preferred embodiment depressants known to the skilled artisan, such as starch, can be used to advantage to increase the recovery of the mineral values from phosphate or iron ores.

In a preferred embodiment, the phosphate ore is from the so-called Florida phosphate ore, which typically is relatively low in carbonate impurities after washing and sizing. Generally, a phosphate rougher concentrate in the size range from plus 200 mesh (U.S. Sieve Size) to minus 1 millimeter is amenable to beneficiation by the disclosed process.

The practice of the method of this invention can be used alone to beneficiate siliceous phosphate ore after washing, desliming and sizing the ore. However, this collector is more preferably used to beneficiate the so-called "rougher float concentrate" obtained from flotation of the phosphate values in the ore with a fatty acid and subsequent removal of the residual fatty acid coating.

The flotation collector, as hereinbefore described, can be used in the separation of siliceous matter from phosphate values in a manner like that known in the art for other cationic amine collectors. The flotation feed is deslimed and treated with mineral acid to remove residual fatty acid collector coatings. The collector and other flotation reagents are then introduced into an aqueous pulp of the phosphate feed at a density suitable for flotation. The order of addition of these reagents is not generally critical. The feed can be briefly conditioned with the collector, or, less preferably, aerated without conditioning to float the siliceous matter. The concentrated phosphate rock is then recovered in the underflow.

The optimum loading of the ether amine or hydroxyalkylated ether amine collector to produce best separation and greatest recovery of the phosphate values is influenced by the relative concentration of phosphate and insolubles (such as sand) in the flotation feed, the use of other collectors, the type and size distribution of ore bodies, the loading of other flotation adjuvants (for example, fuel oil, or depressants, such as starch) and other factors. Generally, if the compound of formula I or its acid salt is the only collector employed, a ratio of from about 0.05 to about 1 kilogram of the compound per metric ton of flotation feed is desirable. The use of the disclosed collector at the above-described loadings reduces or obviates the need for frothers, such as pine oil, in the flotation medium.

It is generally advantageous to employ fuel oil as an adjuvant to the collector, in the flotation of siliceous matter from phosphate. Representative fuel oils include diesel oil, kerosene, Bunker C fuel oil, mixtures thereof and the like. The fuel oil can operably be employed in any ratio less than about 1 kilogram of fuel oil per ton of flotation feed. Preferably, the fuel oil is present in a ratio of at least about 0.05 kilogram of fuel oil per metric ton of flotation feed. The instant collectors are advantageously dissolved in the fuel oil prior to their addition to the flotation medium.

The following examples are illustrative embodiments of this invention. Unless otherwise indicated all parts and percentages are by weight.

EXAMPLES 1-9

Comparative Experiment

In a series of identical flotation runs that differ only in the loading and identity of the collector employed, a 500 gram charge of phosphate rougher float concentrate, which has been washed with mineral acid and water, is beneficiated. This rougher float concentrate is derived from phosphate ore mined near Bartow, Florida and is typical of the concentrate recovered from froth flotation of the sized ore in the presence of fatty acid in the conventional manner. The concentrate is diluted with water to obtain a slurry with a pulp density of about 20 percent solids. The slurry is transferred to a Wemco flotation machine and an ether amine collector is added.

The ether amine collector corresponds to formula I, wherein w, x and z are each 0, R and R'' are hydrogen at each occurrence and R' is either a $C_5$ alkyl-, $C_8$ alkyl- or $C_{12}$ alkyl-substituted phenyl. These ether amine collectors consist of a mixture of isomers, except in the case of the $C_5$ alkyl which is a tert-amyl group. Para substitution of the phenyl group predominates in each instance. These alkyl-substituted phenyl ether amines are prepared by the reaction of equimolar amounts of an alkylated phenol, propionic acid and monoethanolamine in a liquid phase reaction medium at from 150° to 250° C. followed by acid-catalyzed hydrolysis of the resulting ether amide product to the desired ether amine. The ether amines are recovered by fractional distillation at reduced pressure.

A conventional condensate of diethylenetriamine (DETA) and a tall oil fatty acid (TOFA) is employed in one comparative experiment as a collector at a loading of 0.3 kilograms of condensate per ton of ore to provide a basis for comparison of the efficacy of the instant ether amine collectors. This prior art collector is introduced into the flotation slurry with an equal weight of #2 fuel oil.

The ether amine collectors are each dissolved in a quantity of fuel oil equal to their own weight. The fuel oil/collector mixture is emulsified in water to produce a 5 percent aqueous dispersion. These emulsions are then titrated with acetic acid to a pH of 7.0 to produce the partial acetate salt of the ether amine.

The above-described collectors are introduced into the flotation slurry at the loadings in kilograms of collector per metric ton of ore tabulated in Table I. The phosphate rougher float concentrate is then briefly conditioned with the collector and fuel oil by high speed agitation of the flotation medium. Flotation is promoted by aeration of the medium with mixing at a reduced speed for two or three minutes, during which the floating concentrate is collected.

The collected concentrate and tail material are individually dewatered by 150 mesh screen, dried and weighed. Both the concentrate and tail fractions are analyzed for percent BPL by standard photometric methods.

In Table I is tabulated the identity of the collector, the loading of the collector in kilograms per metric ton of phosphate feed and the BPL assay of the tail and concentrate for each run. The weight distribution of phosphate in each of these fractions is also normalized and tabulated as a percentage of the total phosphate to provide indices of the degree of separation effected.

TABLE I

| Example | Collector | Loading (kg/ton) | Tail (BPL) | Conc. (BPL) | Normalized Distribution % Tail | % Conc. |
|---|---|---|---|---|---|---|
| 1 | $C_5$ alkyl-(phenyl) ether amine | 0.10 | 64.5 | 5.0 | 99.25 | 0.75 |
| 2 | $C_5$ alkyl-(phenyl) ether amine | 0.20 | 68.1 | 22.0 | 91.48 | 8.52 |
| 3 | $C_5$ alkyl-(phenyl) ether amine | 0.25 | 71.4 | 30.4 | 84.44 | 15.56 |
| 4 | $C_8$ alkyl-(phenyl) ether amine | 0.05 | 67.2 | 5.5 | 98.78 | 1.22 |
| 5 | $C_8$ alkyl-(phenyl) ether amine | 0.10 | 71.1 | 13.6 | 94.94 | 5.06 |
| 6 | $C_8$ alkyl-(phenyl) ether amine | 0.20 | 72.6 | 22.6 | 89.30 | 10.70 |
| 7 | $C_{12}$ alkyl-(phenyl) ether amine | 0.05 | 69.4 | 13.8 | 95.32 | 4.66 |
| 8 | $C_{12}$ alkyl-(phenyl) ether amine | 0.10 | 71.6 | 21.2 | 90.15 | 9.85 |
| 9 | $C_{12}$ alkyl-(phenyl) ether amine | 0.15 | 72.0 | 30.4 | 81.89 | 18.11 |
| Comparative Experiment* | DETA/TOFA | 0.30 | 64.4 | 8.5 | 97.34 | 2.66 |

*Not an embodiment of this invention.

EXAMPLES 10–11

Two flotation runs are performed in the same manner as Example 1, with the exception of the collector employed and its loading. In these two runs, the ether amine introduced in Examples 4–6 is reacted in the conventional manner with an equimolar quantity of propylene oxide. Therefore, x is 1 and Q is $-CH_2-CH-CH_3$ or

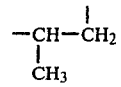

in the formula of this compound. These alkoxylated compounds are introduced to the flotation medium in aqueous dispersions with fuel oil as in Example 1. The relevant operating parameters and results are tabulated in Table II.

TABLE II

| Example | Loading (kg/ton) | Tail (BPL) | Conc. (BPL) | Normalized Distribution % Tail | % Conc. |
|---|---|---|---|---|---|
| 10 | 0.2 | 71.2 | 13.7 | 95.33 | 4.67 |
| 11 | 0.3 | 73.2 | 15.8 | 94.28 | 5.72 |

EXAMPLES 12–14

Three flotation runs are made in the same manner as Examples 4–6, with the exception of the loading of the collector and the addition of a corn starch as a depressant to decrease the coflotation of phosphate with silica. In these three runs 0.025 or 0.05 kilograms of corn starch per metric ton of rougher concentrate is charged to the flotation medium contemporaneous with the addition of the collector/fuel oil dispersion. The corn starch is added as a 5 percent aqueous solution, which is prepared by adding the corn starch to water and then boiling for fifteen minutes. The relevant operating parameters and results are tabulated in Table III.

TABLE III

| Example | Collector (kg/ton) | Starch (kg/ton) | Tail (BPL) | Conc. (BPL) | Normalized Distribution % Tail | % Conc. |
|---|---|---|---|---|---|---|
| 12 | 0.15 | 0.025 | 70.4 | 8.0 | 97.27 | 2.73 |
| 13 | 0.20 | 0.05 | 71.7 | 8.9 | 96.94 | 3.06 |
| 14 | 0.20 | 0.10 | 73.0 | 6.7 | 98.03 | 1.97 |

What is claimed is:

1. In a process for beneficiating a siliceous mineral ore by froth flotation with a collector system for the flotation of siliceous matter, the improvement wherein the collector system comprises an effective amount of a compound represented by the formula I

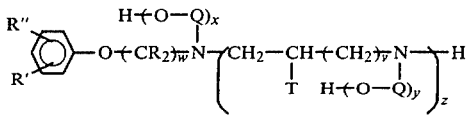

I or an acid-neutralized derivative of this compound, wherein R′ is an aliphatic radical having 2 to 22 carbon atoms; R″ is hydrogen or an aliphatic radical having 2 to 22 carbon atoms; each R is independently hydrogen, a $C_1$–$C_4$ hydroxyalkyl or $C_1$–$C_4$ alkyl; Q is

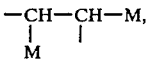

wherein M at each occurrence is independently hydrogen, methyl or ethyl, with the proviso that Q at each occurrence contains no more than 4 carbon atoms; T is hydrogen or methyl; w is 2 or 3, and v, x, y and z are each independently 0 or 1.

2. The process as described in claim 1 wherein the mineral ore is a phosphate ore.

3. The process as described in claim 2 wherein w is 2 and z is 0.

4. The process as described in claim 2 or 3 wherein an effective amount of starch is present during flotation to selectively depress the flotation of phosphate values.

5. The process as described in claim 3 wherein R, T and R″ are each hydrogen.

6. The process as described in claim 5 wherein R′ is a normal or branched alkyl having 5 to 20 carbon atoms.

7. The process as described in claim 2 or 6 wherein fuel oil is present during flotation as an adjuvant to the collector.

8. The process as described in claim 6 wherein x is 1.

9. The process as described in claim 6 wherein the phosphate ore is a rougher float concentrate and the collector is an acetic acid-neutralized derivative of a compound of formula I present in a ratio of from about 0.05 to about 1 kilogram of collector per metric ton of the rougher float concentrate.

* * * * *